US008850646B2

(12) United States Patent
Stelter et al.

(10) Patent No.: US 8,850,646 B2
(45) Date of Patent: Oct. 7, 2014

(54) ANTI-DECUBITUS CUSHION

(75) Inventors: Nils Stelter, Frasdorf (DE); Rainer Pfeffermann, Rosenheim (DE)

(73) Assignee: Amoena Medizin-Orthopadie-Technik GmbH (DE)

( * ) Notice: Subject to any disclaimer, the term of this patent is extended or adjusted under 35 U.S.C. 154(b) by 91 days.

(21) Appl. No.: 13/321,044

(22) PCT Filed: Apr. 13, 2010

(86) PCT No.: PCT/EP2010/002267

§ 371 (c)(1),
(2), (4) Date: Nov. 17, 2011

(87) PCT Pub. No.: WO2010/133277

PCT Pub. Date: Nov. 25, 2010

(65) Prior Publication Data

US 2012/0060293 A1 Mar. 15, 2012

(30) Foreign Application Priority Data

May 18, 2009 (DE) ..... 20 2009 007 116 U

(51) Int. Cl.
*B68G 5/00* (2006.01)
*A47C 16/00* (2006.01)
*A61G 7/07* (2006.01)

(52) U.S. Cl.
CPC ..... *A61G 7/072* (2013.01); *Y10S 5/909* (2013.01); *Y10S 5/925* (2013.01); *Y10S 5/926* (2013.01)
USPC ..... 5/654; 5/655.5; 5/644; 5/909; 5/925; 5/926

(58) Field of Classification Search
CPC ..... A47G 9/10; A47G 9/1027
USPC ..... 5/654, 655.5, 644, 909, 925, 926
See application file for complete search history.

(56) References Cited

U.S. PATENT DOCUMENTS

| | | | | |
|---|---|---|---|---|
| 6,219,867 | B1 * | 4/2001 | Yates | 5/655.5 |
| 7,036,162 | B1 * | 5/2006 | Gatten | 5/421 |
| 2005/0278852 | A1 | 12/2005 | Wahrmund et al. | |
| 2007/0044239 | A1 | 3/2007 | Leifermann et al. | |
| 2008/0178390 | A1 * | 7/2008 | DuDonis | 5/632 |
| 2009/0083908 | A1 | 4/2009 | Fry | |
| 2009/0235460 | A1 * | 9/2009 | Hitch et al. | 5/654 |

FOREIGN PATENT DOCUMENTS

GB 2 310 394 A 8/1997

OTHER PUBLICATIONS

International Search Report corresponding to International Application No. PCT/EP2010/002267, dated Jul. 8, 2010; 4 pages.

* cited by examiner

*Primary Examiner* — Robert G Santos
*Assistant Examiner* — David E Sosnowski
(74) *Attorney, Agent, or Firm* — Carter, DeLuca, Farrell & Schmidt, LLP

(57) ABSTRACT

The present invention relates to a decubitus cushion comprising a core and a jacket, wherein the core comprises viscoelastic material and the jacket comprises a cover layer of material promoting air circulation fixedly or reversibly removable at at least the side facing the skin.

13 Claims, 5 Drawing Sheets

ANTI-DECUBITUS CUSHION

Figure 1:
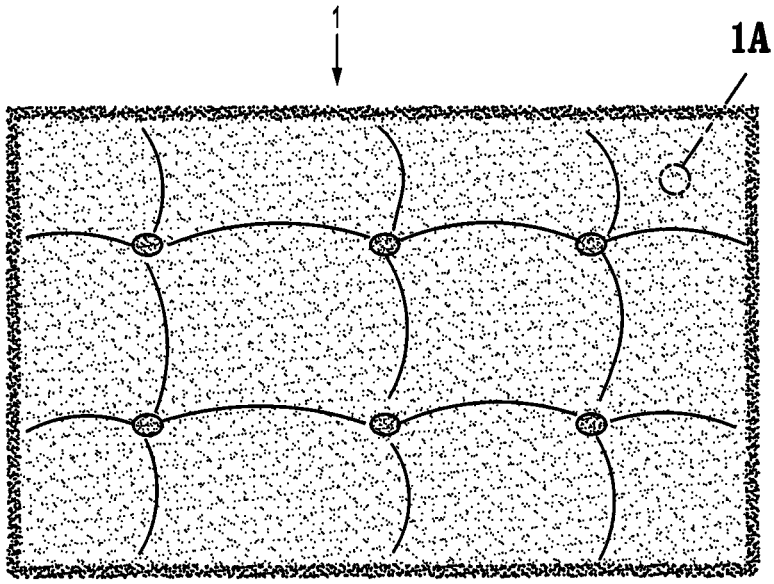

This application claims priority to German Application No. 20 2009 007 116.2, filed May 18, 2009and PCT Application No. PCT/EP2010/002267, filed Apr. 13, 2010, the entireties of which are both hereby incorporated by reference.

The present invention relates to a cushion/a support for decubitus prophylaxis, substantially comprising a core and a jacket, with the side facing the skin having material which promotes air circulation and the core having viscoelastic material.

A decubitus ulcer is caused by a prolonged pressure on a part of the surface of the body, for example due to being bedridden or immobile. Further risk factors for the formation of a decubitus ulcer include poor oxygen supply to the contact field, moisture in the contact field (in particular in patients with fever or with obese patients) and specific diseases in patients (for example, cardiac insufficiency and diabetes mellitus). As a prophylaxis against (or optionally a treatment of) decubital ulcer(s), cushions and supports are consequently used which are primarily intended to reduce the maximum contact pressure, but also allow additionally improved air circulation and improved heat balance. Such cushions are above all used in intensive-care medicine, in geriatric care, furthermore in hospitals and as a cushion for wheelchairs. They are generally used everywhere where there is a risk of decubitus due to being immobile and to being bedridden.

Decubitus cushions typically counter prolonged pressure effects onto the surface of the body in that they distribute the weight of the patient over a larger contact surface or in that a spatially restricted pressure effect only takes place over a short time period and is subsequently translocated.

It is the aim of the present invention to develop a decubitus cushion which is particularly soft and adaptable and distributes the pressure in a very balanced manner over a large contact surface and additionally largely avoids heat accumulation and moisture at the contact surface.

This object is achieved by means of a decubitus cushion in accordance with claim 1.

The term "side facing the skin" such as is used in the course of the following description and of the claims is intended to designate those outer surfaces of a cushion which face the patient on use. The term "side remote from the skin" such as is used in the course of the following description and of the claims is intended to designate those outer surfaces of a cushion which are remote from the patient on use.

In an embodiment, the decubitus cushion in accordance with the invention also has a cover layer on the side remote from the skin, which results in a two-sided usability. This can be expedient for specific applications, for example on a use between the legs on a side position of the patient.

Decubitus cushions in accordance with the invention can be round, oval, rectangular, trapezoidal and asymmetric and have the size of small cushions (surface approximately 500 $cm^2$) up to the size of blankets (surface approximately 2 $m^2$). The term "surface" in this connection means the one-sided surface, i.e. the surface which the cushion covers in a vertical view. In an embodiment, the cushions have a surface of between approximately 500 $cm^2$ and approximately 2000 $cm^2$; in another embodiment a surface of between approximately 0.2 and approximately 0.5 $m^2$; in an in turn other embodiment between approximately 0.5 $m^2$ and approximately 1 $m^2$, and in a further embodiment between approximately 1 $m^2$ and approximately 2 $m^2$. The cushions can furthermore have one or more regularly or irregularly distributed, equally or unequally dimensioned sealings. Cushions in accordance with the invention have a flat design; their horizontal dimensions exceed their thickness by more than three times, preferably by more than 5 times, and particularly preferably by more than 10 times.

The cover layer can, for the case that it is connected to the jacket of the decubitus cushion in a reversibly removable manner, have a reversibly adhesive surface and/or one or more reversibly adhesive attachments on the side facing the cushion. A preferred material for this side facing the cushion is a velour reversibly connectable to a hook tape. This velour surface can be reversibly connected by a double-sided hook tape which follows the principle of a hook and loop fastener to the jacket of the cushion. A preferred material for the jacket of the cushion is likewise a velour reversibly connectable to a hook tape.

The layer promoting air circulation includes one or more materials selected from a textile spacer fabric, an open-cell foam, a fleece or another material known to the skilled person. These materials effect a good dehumidification of the skin of the patient and provide a constantly dry microclimate. They furthermore act to balance pressure and heat and provide, in addition to the core of the cushion described in the following, an ideal weight distribution of the patient at the cushion and an avoidance of local heat accumulation.

The core of the decubitus cushion includes viscoelastic material which becomes soft by heating and nestles even more strongly than other materials to the geometry of the body. Flexible, gel-like materials such as cross-linked silicone are preferred. In an embodiment, the filling of the decubitus cushion includes one or more thixotropic fluids in addition to viscoelastic materials. Due to their special properties, according to which the viscosity increases after the influence of a shear effect, the local pressure accumulation at a part of the surface of the body of the patient is further reduced by the cushion and the adaptability is further increased. Additionally, to achieve a flexibly adaptable pressure relief, the core can contain refillable filler materials such as fiberfill, filler granulate or filler spheres and can be reversibly fillable with same.

To achieve an ideal temperature regulation, the core has a phase change material (PCM) in a further embodiment. It has a condensation point close to body temperature and absorbs body heat when too much is produced which it emits at the other side when the temperature becomes too low. A constant microclimate at the contact surface of the patient results therefrom.

It is in turn preferred that the core of the decubitus cushion is divided into a plurality of mutually connected chambers. Flowable filler material can thus move freely between the different chambers to effect an ideal pressure compensation and an ideal weight distribution, with the cushion, however, approximately maintaining its shape due to the compartmentalization even under the effect of pressure.

In an embodiment, the decubitus cushion has a film on the whole surface of the jacket to prevent the entry and exit of fluid media from or into the core. This cover layer is preferably attached to the inner side of the jacket. In this respect, malleable plastics, in particular polyurethane, are suitable as the material; however, the skilled person will also be able to find further suitable materials. A cover layer fixedly or removably attached to the jacket of the cushion can have such a liquid-repellant film in part or over its whole surface. It can, for example, serve the retention of perspiration.

The decubitus cushion preferably has a reversibly adhesive surface on the side remote from the skin via which the cushion can be reversibly connected to itself, to further decubitus cushions and/or to an underlay. A preferred material for this reversibly adhesive surface is a velour reversibly connectable to a hook tape. This velour surface can be reversibly connected to other elements by means of a double-sided hook tape which follows the principle of a hook and loop fastener.

A plurality of decubitus cushions can be combined to an optimized device for pressure relief. A suitable surface and/or a suitable attachment makes it possible to position individual or several cushions fast and secured against slipping on a bed sheet, a mattress or similar underlays or to connect them to one another. This allows a pressure relief especially and individually optimized to the patient.

Cushions in accordance with the invention can also be combined with a support. A preferred example includes such combinations, wherein the support has at one or more positions removable parts, which can be substituted with decubitus cushions in accordance with the invention as required, or recesses into which decubitus cushions in accordance with the invention can be inserted as required.

Further details, features and advantages result from the enclosed drawing.

Figure 1A:
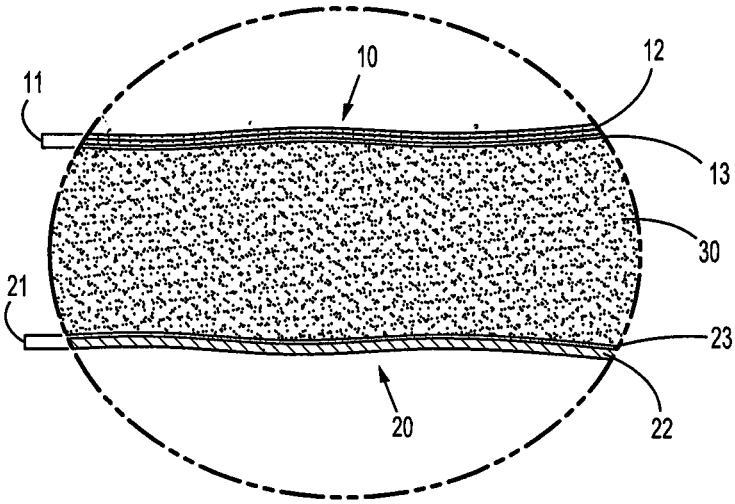

FIG. 1 shows a top view of an embodiment of a decubitus cushion 1 in accordance with the invention and FIG. 1A shows a cross-sectional view of the area of detail of FIG. 1. The core 30 of thixotropic, fluid material is surrounded on both sides, i.e. on the side 10 facing the skin and on the side 20 remote from the skin, by jackets 11 and 21, with the jacket 11 having a cover layer of material 12 promoting air circulation and a film 13 on the side 10 facing the skin. The jacket 21 on the side 20 remote from the skin likewise has a film 23 as well as an adhesive surface 22.

Figure 2A:
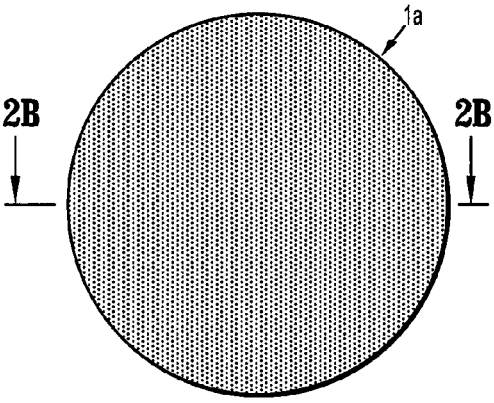
Figure 2C:
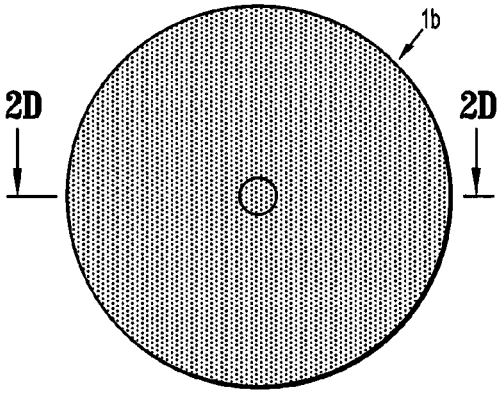
Figure 2B:
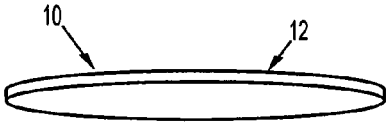
Figure 2D:
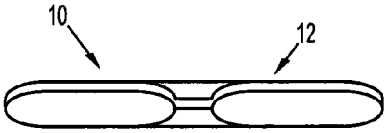
Figure 2E:
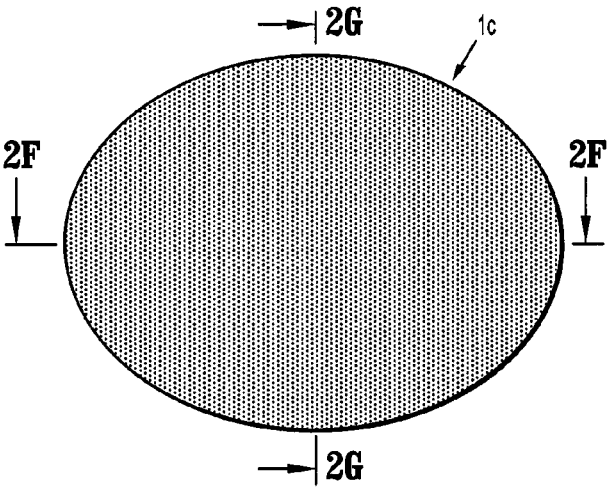
Figure 2G:
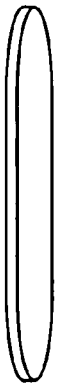
Figure 2F:
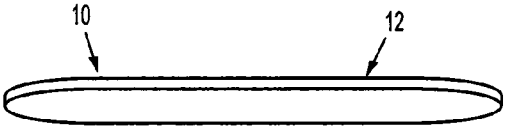

F*igs*. 2A-2F show different forms of decubitus cushions 1*a*, 1*b*, 1*c* in accordance with the invention. The side 10 facing the skin is equipped with a cover layer of material 12 promoting air circulation. FIG. 2A is a top view of a round embodiment of decubitus cushion 1*a* and FIG. 2B is a view of decubitus cushion 1*a* taken along section line 2B-2B of FIG. 2A. FIG. 2C is a top view of decubitus cushion 1*b* with additional central sealing and FIG. 2D is a view of decubitus cushion 1*b* taken along section line 2D-2D of FIG. 2C. FIG. 2E is a top view of an oval embodiment of decubitus cushion 1*c*. FIG. 2F is a view of decubitus cushion 1*c* taken along section line 2F-2F of FIG. 2E and FIG. 2G is a view of decubitus cushion 1*c* taken along section line 2G-2G of FIG. 2E.

Figure 3A:
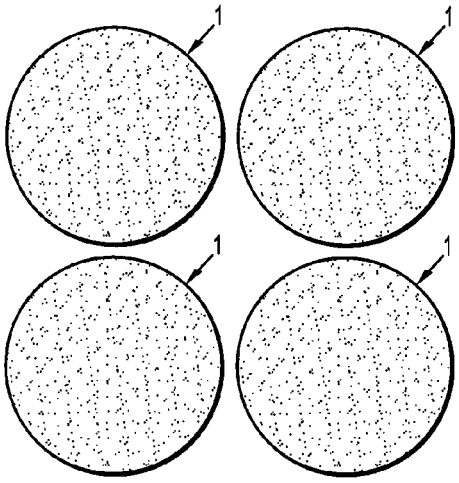
Figure 3B:
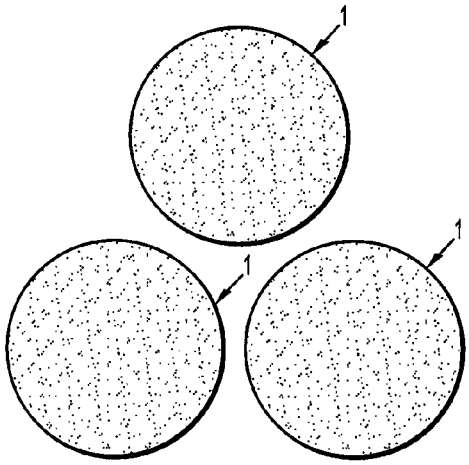
Figure 3C:
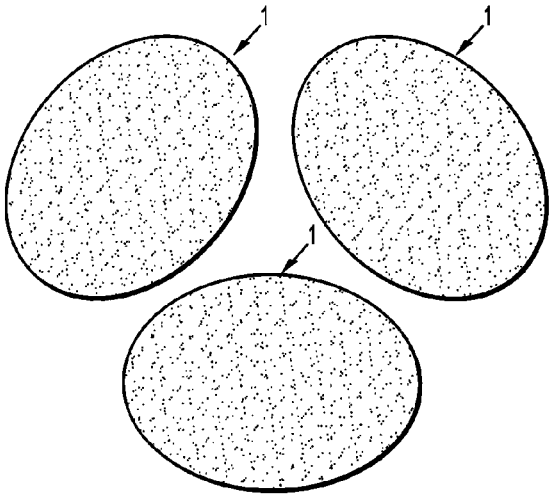

FIGS. 3A-3C show possible arrangements of individual decubitus cushions 1 in accordance with the invention on an underlay. In particular, FIG. 3A shows an arrangement example with four round individual decubitus cushions 1, FIG. 3B shows an arrangement example with three round individual decubitus cushions 1, and FIG. 3C shows an arrangement example with three oval individual decubitus cushions 1.

Figure 4:
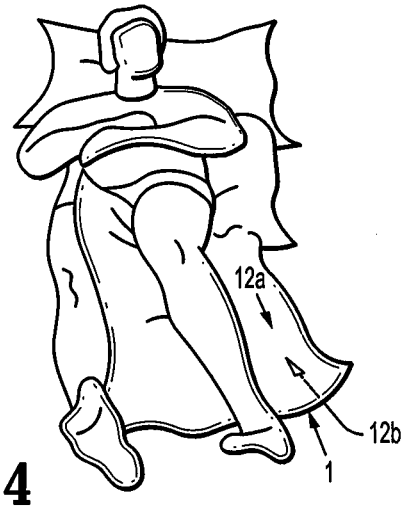

FIG. 4 shows a sensible use of a decubitus cushion in accordance with the invention, equipped on both sides with cover layers of material 12, 12*a* promoting air circulation.

Figure 5:
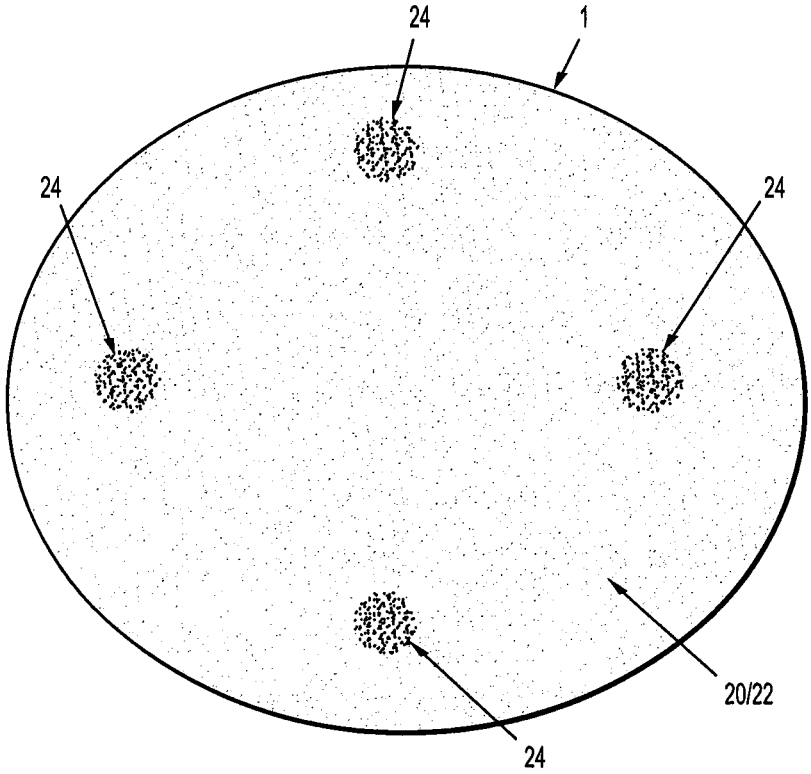

FIG. 5 shows an embodiment of a decubitus cushion 1 in accordance with the invention which has on the side 20 remote from the body hook tapes 24 of a hook and loop type which are fastened to the adhesive surface 22.

Figure 6:
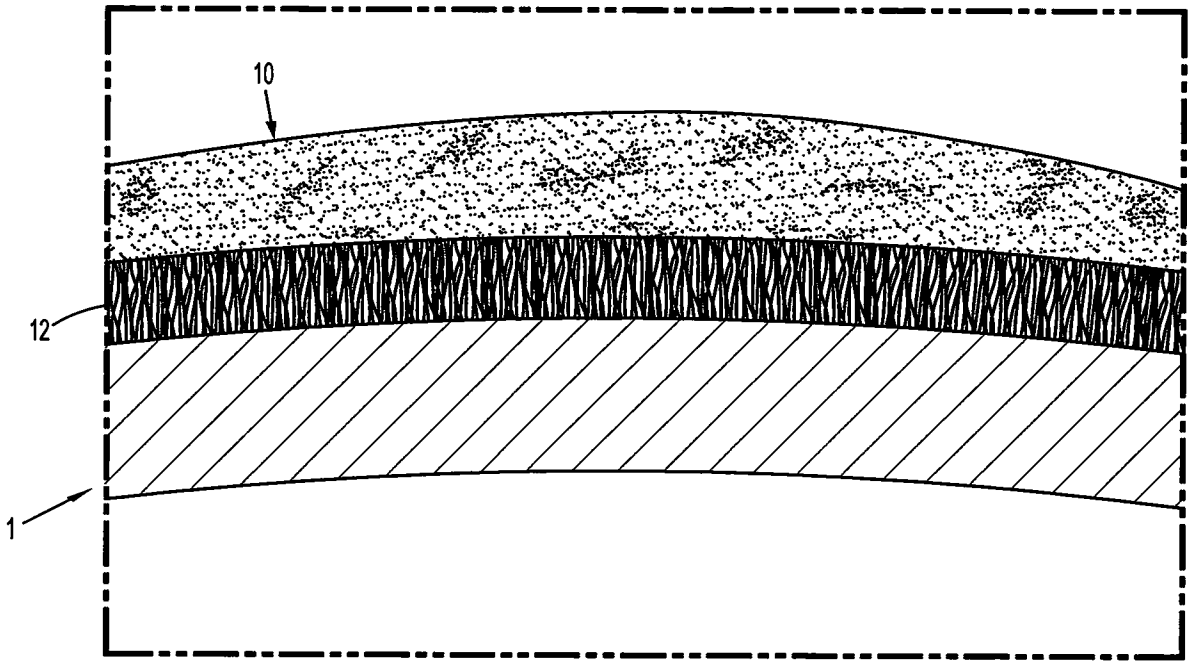

FIG. 6 shows a magnification of a cover layer of material 12 promoting air circulation here a textile spacer fabric, directly attached to the side 10 facing the skin of the decubitus cushion 1 in accordance with the invention.

The invention claimed is:

1. A decubitus cushion comprising:

a core and a jacket, the jacket having a first side and a second side, the second side facing the core, wherein the core comprises viscoelastic flowable filler material and the jacket includes a cover layer of material promoting air circulation on the first side and a film on the second side, wherein the cover layer is separable from the film, and the cover layer is a dry microclimate inducing layer.

2. A decubitus cushion in accordance with claim 1, wherein the core further comprises thixotropic fluids.

3. A decubitus cushion in accordance with claim 1, wherein the core comprises phase change material.

4. A decubitus cushion in accordance with claim 1, wherein the core comprises a plurality of mutually connected chambers.

5. A decubitus cushion in accordance with claim 1, wherein the film is impermeable to liquid.

6. A decubitus cushion in accordance with claim 1, wherein the cover layer is equipped partly or on its total surface with a film impermeable to liquid.

7. A decubitus cushion in accordance with claim 1, wherein the material promoting air circulation is a textile spacer fabric and/or an open cell foam and/or a non-woven material.

8. A decubitus cushion in accordance with claim 1, wherein a side of the decubitus cushion has a reversibly adhesive surface.

9. A decubitus cushion in accordance with claim 1, wherein the decubitus cushion is reversibly connected via a reversibly adhesive surface to a second decubitus cushion and/or an underlay.

10. A decubitus cushion in accordance with claim 1, wherein the dry microclimate inducing layer controls temperature, moisture, and pressure.

11. A decubitus cushion in accordance with claim 1, wherein a side of the cover layer includes an adhesive.

12. A decubitus cushion in accordance with claim 1, wherein a side of the cover layer has a non-slip surface.

13. A decubitus cushion in accordance with claim 1, wherein the cover layer is reversibly connected to the film via a velour and hook fastener arrangement.

* * * * *